US005277334A

United States Patent [19]

Malinconico

[11] Patent Number: 5,277,334

[45] Date of Patent: Jan. 11, 1994

[54] MEDIA DISPENSER WITH ACTUATION REGISTER

[75] Inventor: Guiseppe Malinconico, Singen, Fed. Rep. of Germany

[73] Assignee: Ing. Erich Pfeiffer GmbH & Co. KG, Fed. Rep. of Germany

[21] Appl. No.: 766,037

[22] Filed: Sep. 26, 1991

[30] Foreign Application Priority Data

Sep. 27, 1990 [DE] Fed. Rep. of Germany ..... 4030530

[51] Int. Cl.[5] ..... B67D 5/22

[52] U.S. Cl. ..... 222/36; 222/49; 222/321

[58] Field of Search ..... 222/36, 41, 47, 48, 222/49, 321, 507

[56] References Cited

U.S. PATENT DOCUMENTS 3,223,282 12/1965 Kloehn ..... 222/41
3,357,607 12/1967 Trott et al. ..... 222/507
3,678,884 7/1972 Robbins ..... 116/121
4,169,474 10/1979 Wagner ..... 128/272.3
4,871,092 10/1989 Maerte ..... 222/41 X
4,921,142 5/1990 Graf et al. ..... 222/320 X
4,962,868 10/1990 Borchard ..... 222/49

FOREIGN PATENT DOCUMENTS 0269496 6/1988 European Pat. Off. .

*Primary Examiner*—Andres Kashnikow
*Assistant Examiner*—Joseph A. Kaufman
*Attorney, Agent, or Firm*—Quarles & Brady

[57] ABSTRACT

The acquisition device of a discharge apparatus is operated by a servodrive, which has at least one control cam constantly engaging in a cam path. The control cam is directly provided on the actuating cap for the discharge actuator, while the cam path is located on the circumference of a fastening cap for the discharge feeder, so that no additional component is required for forming the acquisition device.

15 Claims, 1 Drawing Sheet

MEDIA DISPENSER WITH ACTUATION REGISTER

BACKGROUND OF THE INVENTION

The invention relates to discharge apparatus for media, which is provided with a discharge actuating means for carrying out the discharge process. For the acquisition, storage and display of data, such as relevant data concerning the use of the discharge apparatus, one or more data acquisition or memory means are provided, which are appropriately located directly on and not separately from the discharge apparatus. The data to be acquired can be the number of uses which have taken place, the next planned use or other data, which can be rendered visible by one or more synchronously or separately connected displays. The data acquisition means is manually advanced with one or more actuating members by means of one or more control drives, the actuating member being separate from the discharge actuating means or can be formed by a member for discharging the medium through manual pressure or the like. The latter case leads to a positive actuation of the acquisition means with each discharge actuation. This can be brought about in that web-like control cams on the inner circumference of a discharge actuating or operating cap are engaged and disengaged relative to web-like countercams on the outer circumference of a data acquisition member rotatably mounted on a dispenser base, which is then rotated one cam division during each actuating stroke. In the past, the interengaging cams formed a servodrive, which in the releasing, starting position of the known discharge apparatus, is completely disengaged, so that the data acquisition member can only be secured by friction, catching, etc. with respect to the actuating member. This can be undesirable if a rotary part of the data acquisition device is normally accessible and could therefore be unintentionally adjusted.

OBJECTS OF THE INVENTION

An object of the invention is to provide a discharge apparatus of the aforementioned type, which avoids the disadvantages of known constructions and which, in particular, in simple manner, provides security against accidental adjustment of the data acquisition means. Other objects will be apparent from the effects and advantages described.

SUMMARY OF THE INVENTION

Appropriately, the control or adjusting members of the data acquisition servodrive are substantially directly interengaged in all positions, or at least in the release position of the discharge actuator. This substantially avoids reciprocal movements corresponding to an advance of the data acquisition means. If the discharge actuating movement is a lift stroke movement and the indicator control movement is a rotary movement, then the two control members lock one another to prevent further control movements without associated actuating movements.

The use of a control link or cam path makes it possible to provide interconnected individual cam members for one discharge process which can be constructed in a randomly different manner. Therefore, discharge processes with different characteristics can be provided, which are necessarily successively controlled, because the cam path can only be traversed continuously in one direction by the control cam. For example, adjacent individual cam members can define different actuating strokes, and therefore dosage quantities, to be discharged or they can bring about varying rotation steps of the control members relative to one another. Such a construction is also suitable for discharge apparatus in which the servodrive is not used for registering the discharge processes.

The cam path also makes it possible to stop limit the control cam in at least one individual cam cycle in the release position or not to limit the same on at least one individual cam cycle with respect to movements beyond said release position. This can also be provided relative to the actuating end position or movements beyond the same. Thus, reciprocally displaced release positions and reciprocally displaced operating end positions are conceivable.

In place of a manual return to the release position, return can also be appropriately brought about by a return spring, which is appropriately located within a pump cylinder for the purposes of a pump piston of the discharge apparatus, so that no separate spring is required for the control members.

A simple and reliably operating construction is obtained if one of the control members is directly formed by an actuating cap provided with a discharge extension or stud and the other control member by a sleeve-like or similar fastening member for fastening a discharge pump to a bottle neck, which is closely enveloped on the outer circumference by the actuating cap. In many discharge apparatus, these two components unavoidably exist, so that no additional component is required for the provision of a data acquisition or indicator means. By the interaction of at least one control cam and at least one associated cam path, the actuating cap is in constant engagement with the fastening member, so that rotary movements of the actuating cap corresponding to the cam configuration are only possible simultaneously with lifting motions. The fastening member could also be in one piece with a cylinder casing of the discharge pump or its end cover or with the seal for sealing with respect to the bottle neck, which leads to a further constructional simplification.

The use of a cam path also makes it possible at the end of a given number of discharge processes to provide a stop-limited release position, which is closer to the operating end position than the usual release positions. This position can coincide with a venting position, in which the interior of the bottle is vented through the discharge pump by opening a vent valve formed by the pump. This position can also coincide with an opening position for an outlet valve, which connects the pump chamber to an outlet channel and is stop-opened. In this end position, any further use of the discharge apparatus is prevented.

BRIEF FIGURE DESCRIPTION

These and further features can be gathered from the claims, description and drawings and the individual features, both singly and in the form of subcombinations, can represent independently protectable constructions for which protection is hereby claimed, either in an embodiment of the invention or in other fields. An embodiment of the invention is described in greater detail hereinafter relative to the drawings, wherein show:

FIG. 1 An inventive discharge apparatus in axial section.

FIG. 2 A detail of a control member in a developed projection.

DETAILED DESCRIPTION OF A PREFERRED EXAMPLE EMBODIMENT

Figure 1:
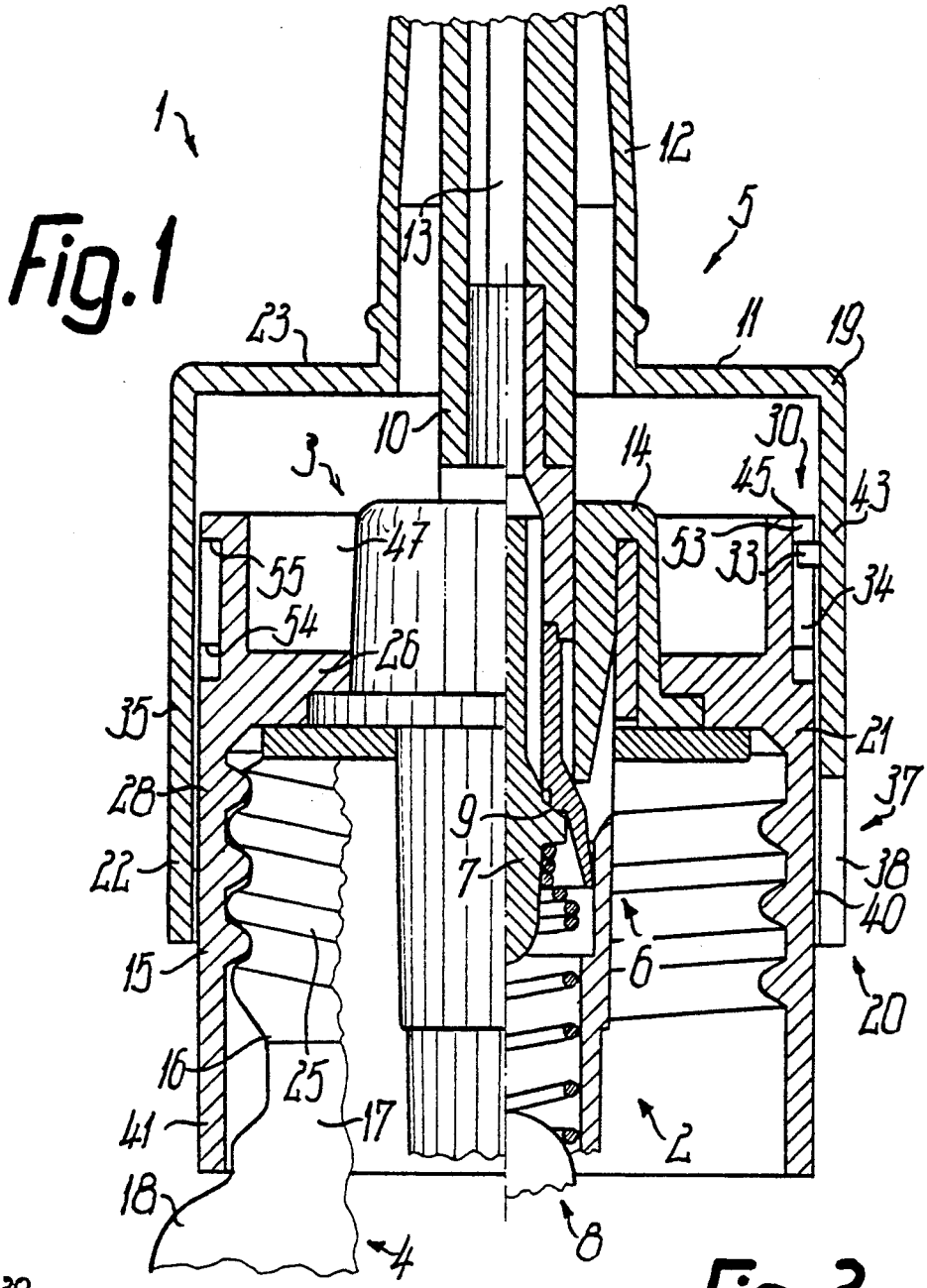
Figure 2:
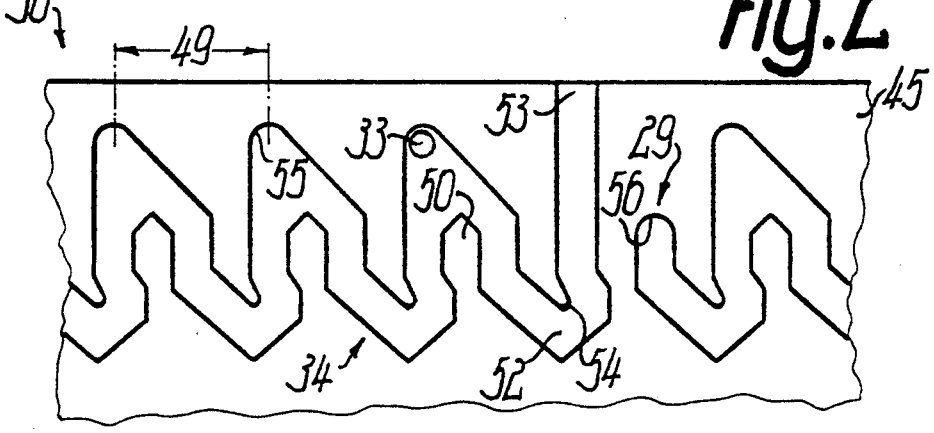

The discharge apparatus 1 has a discharge unit 2, constructed as a closed subassembly, which includes a discharge pump 3 and is to be fixed as an entity to a storage vessel by a snap connection, a crimp ring, a screw coupling, etc. The apparatus includes a discharge actuating means 5 for the manual discharge of a dosed discharge quantity. A pump stroke operates the piston unit 7 of a pump 6 largely engaging in the storage vessel 4 and whose pump chamber has a valve-controlled inlet 8 and a valve-controlled outlet 9. The discharge actuating means 5 can be a handle having on an end face an actuating or operating member or surface 11, which surrounds a plunger or operating ram 10, which is preassembled with the piston unit 7 by means of a plug connection and is a component of the delivery handle. The ram 10 is traversed by an outlet channel 13 connected to the outlet 9 and surrounded by a discharge stud 12 projecting freely over the actuating surface 11 and which in the vicinity of its free end has the outlet opening (not shown) of the discharge unit 2. The cylinder casing or a piston cover traversed by the operating ram 10 forms a carrying member 14, with which the discharge pump 3 is fixed by a fastening member 15, such as a screw cap, to the vessel neck 17, which forms a corresponding vessel flange 16. The part of the carrying member 14 projecting from the storage vessel 4 and the fastening member 15 are over engaged over part of their length by a cap 19, whose end wall forms the operating surface 11.

For the forced indication of each actuation stroke is provided a data determining or acquisition device 20, which has a body 21, which is easily detachable from the discharge pump 3, is substantially sleeve-like and is integral with the fixing member 15. The data acquisition device 20 also has a sleeve-like data acquisition member 22, which closely surrounds the body 21 in axially displaceable and rotary manner and can be formed by the jacket 35 of the cap 19. In the vicinity of a radially inwardly projecting mounting flange 26, the body 21 surrounds the carrying member 14 in spaced manner and projects freely against the inside of the end wall of the cap 19. The fixing or fastening member 15 can extend approximately up to the transition of the vessel neck 17 into the widened bulge 18 and consequently forms a sleeve 41 for the complete covering of the vessel 4 up to this area.

The actuating member 23 is formed by the same pressure surface as the the actuating member 11 and has two application surfaces for the user's fingers, each on either side of the discharge stud 12. The outer circumference of the jacket 28 of the fastening member 15 passes approximately continuously over its entire length and the length of the body 21, so that it forms a good guide for the cap 19.

The cap 19 and the body 21 engage one another via a servodrive 20, which during each actuating stroke necessarily brings about a stepwise rotary movement of the cap 19 relative to the body 21 in such a way that the rotation direction is always the same. To this end, a longitudinal portion of the jacket 35 of the cap 19 located between its ends defines a sleeve-like control member 43, and the fastening member 15 with its upper end portion forming the body 21 forms a sleeve-like control member 45. On its cylindrical inner circumference, the control member 43 is provided with two diametrically opposing, radially inwardly projecting, cylindrical control cams 33, which each engage in a cam path 34, which extends around roughly half the circumference of the control member 45. The control cams 33 also engage, in the starting or release position shown in FIG. 1 in the associated cam path 34, in such a way that the cap 19, which is basically detachable from the piston unit 7, is positively prevented from being removed by the discharge pump 3.

For the externally visible display of the operating state of the data acquisition device 20, a display means 27 is provided, which, in the end of the jacket 35 remote from the actuating surfaces 11, 23, is in the form of a display window 38 and, on the outer circumference of the fastening member 15, has a scale 40 with circumferentially uniformly distributed symbols, which, at least in the release position is in the vicinity of the window 38. The scale 40 is located on a side below the mounting flange 26, and the control member 45 with the cam path 34 is essentially formed above the flange 26, the control member 45 being substantially formed by a ring 47 projecting freely over the mounting flange 26. The display means 37 and the servodrive 20 are consequently axially adjacent to one another. The external diameter of the scale 40 is substantially the same as the external diameter of the control member 45 and the internal diameter of the data acquisition member 22 is substantially the same as that of the control member 43. The outer circumference surface of the body 21 passes substantially continuously between the scale 40 and the control member 45. The inner circumferential surface passes substantially continuously between the data acquisition member 22 and the control member 43 and is free from steps. The acquisition member 22 and the control member 43 can be mounted with the cap 19 from the free end of the control member 45 on the body 21 and are consequently fitted in a simple manner. If the discharge pump 3 is previously installed on the body 21 by engagement, then, during the assembly of the cap 9, it is connected by a plug connection to the discharge connection stud 12. If the discharge pump 3 is subsequently installed, it is connected by plug connections at the same time as the body 21 and the cap 19. To this extent, the cap 19 can form a preassembled unit with the body 21.

The cam path 34 is formed by a groove meandering in alternating direction and whose width substantially corresponds to the diameter of the control cam 33, but whose interconnected portions pass into one another under acute and obtuse angles and not under right angles. For each operating step the cam path 34 forms an individual cam cycle 49 and there are 21 individual cam cycles 49 between a link inlet 53, on the start of the cam path 34, and a link end 56. For forming the link inlet 53, the cam groove passes through the free top face of the control member 45, so that here during assembly the control cam 33 can be inserted in the cam path 34. The configuration of the cam path 34 is such that the control cam 33 during the actuating stroke is necessarily rotated by a partial step in the planned rotation direction and during the return stroke is necessarily further rotated in the same direction. For this purpose, in the vicinity of the reversal points 52 of the cam groove, the groove sides form corresponding guide members 50, 54 for the control cam 33. In the release position, the control cam 33 is centered in substantially clearance-free manner between two acute-angled, outer groove sides of the cam groove, which form a stop member 55, against which the control cam 33 is applied under the tension of the return spring of the discharge pump 3. Thus, the cap 19 is positively secured against removal. The distance between adjacent stop members 55 corresponds to an operating step of the servodrive 30 or the effective extension of an individual cam cycle 49.

The link end 56 remote from the link inlet 53 is so axially displaced with respect to the stop members 55, that the discharge pump 3 or the servodrive 30 cannot return as far to its starting position, as is otherwise permitted by the stop members 55. At the end of use of the discharge apparatus 1, components are consequently fixed in a mid-actuating position, which acts in the same way as a display readily visible from the outside, showing that the discharge apparatus is not available for further use. Thus, the link end 56 forms a blocking means 29, which cannot be overcome. The cam path 34 is so constructed leading from the link inlet 53, that for the transfer of the control cam 33 up to the first stop member 55 a complete pump stroke must be performed through which air is removed from the pump chamber and can optionally be filled with the medium by suction from the storage vessel 4.

The actuating members for the discharge and for data acquisition can also be separately actuated, if e.g. the acquisition device is to be operated independently of the discharge actuating means. There can also be two or more jointly or independently operatable data acquisition devices or servodrives for one or more discharge feeders, free of the discharge apparatus 1.

What is claimed is:

1. A dispenser for discharging media from a media reservoir to an outlet through a media pump, said dispenser comprising:

means for actuating a discharge of the media, said discharge actuating means being reciprocally operable in an actuation direction between a release position and an actuated position to actuate the discharge and return to the release position during an operating cycle;

a memory device for registering data relating to the media discharge actuating, said memory device being mounted on the reservoir;

a memory device actuating member connected to said discharge actuating means, said memory device actuating member driving an interaction between control members of said discharge actuating means and said memory device, one of said control members having a control cam and the other control member having a cam groove which receives the control cam, wherein said control cam is automatically shifted along said cam groove transverse to the actuation direction and thereby registers an actuation in said memory device by operation of said discharge actuating means only in said actuation direction during said operating cycle to said actuated position and back to said release position.

2. The dispenser according to claim 1, wherein said control cam engages in said cam groove in all positions of the operating cycle.

3. The dispenser according to claim 1, wherein said cam groove has substantially identical individual path portions passing into one another in sequence, at least one of said path portions providing transition points for positively guiding said control cam in only one transfer direction along said cam groove.

4. The dispenser according to claim 1, wherein said cam groove provides a meandering guide defining at least three stops for said control cam corresponding to three of said operating cycles.

5. The dispenser according to claim 1, further comprising a basic body and wherein said other control member is said basic body which is sleeve-shaped and said cam groove is countersunk in a circumference of said basic body.

6. The dispenser according to claim 1, wherein for inserting said control cam, said cam groove is open only at one starting end providing an axial cam inlet.

7. The dispenser according to claim 1, wherein said control member which provides said control cam is located on a manual actuating cap of said discharge actuating means, said actuating cap providing an inner circumference, a cap end wall of said actuating cap forming a manipulable pressure handle surface.

8. The dispenser according to claim 7, wherein at least one of said control members is provided substantially in one piece with a discharge stud forming the media outlet, said control member providing said control cam having an inner circumference from which said control cam extends.

9. The dispenser according to claim 1, wherein said cam groove is integrally formed in one piece on a fastening member for mounting the pump to the reservoir.

10. The dispenser according to claim 1, wherein at least one of said control members is integrally constructed in one piece with said discharge actuating means.

11. The dispenser according to claim 1, wherein said memory device provides a counting and displaying device; said cam groove being located substantially directly adjacent to a scale on said memory device; said control member carrying said control cam being provided with a scale indicator.

12. The dispenser according to claim 1, wherein said cam groove is constructed for holding at least one of members defined by:

said control cam; and at least one of said actuating member in different ones of said released positions.

13. The dispenser according to claim 1, wherein said control members provide a pull-off preventing means for preventing said discharge actuating member from being removed from said dispenser.

14. A dispenser for discharging media from a media reservoir to an outlet through a media pump, said dispenser comprising:

means for actuating a discharge of the media, said discharge actuating means being reciprocally operable in an actuation direction between a release position and an actuated position during an operating cycle to actuate the discharge;

a memory device for registering data relating to the media discharge actuating, said memory device being mounted on the reservoir;

a memory device actuating member connected to said discharge actuating means, said memory device actuating member driving an interaction between control members of said discharge actuating means and said memory device, one of said control members having a control cam and the other control member having a cam groove which receives the control cam, wherein operation of said discharge actuating means through said operating cycle automatically shifts said control cam along said cam groove transverse to the actuating direction and registers an actuation in said memory device, wherein said control cam abuttingly engages in said cam groove in at least one of positions defined by said release position and an end position at a rear link end of said cam groove; said control cam being spring-biased towards an initial position of said discharge actuating means.

15. A dispenser for discharging media from a media reservoir to an outlet through a media pump, said dispenser comprising:

means for actuating a discharge of the media, said discharge actuating means being reciprocally operable in an actuation during an operating cycle to actuate the discharge;

a memory device for registering data relating to the media discharge actuating, said memory device being mounted on the reservoir;

a memory device actuating member connected to said discharge actuating means, said memory device actuating member driving an interaction between control embers of said discharge actuating means and said memory device, one of said control members having a control cam and the other control member having a cam groove which receives the control cam, wherein operation of said discharge actuating means through said operating cycle automatically shifts said control cam along said cam groove transverse to the actuating direction and registers an actuation in said memory device, wherein at a rear link end, said cam path forms means for blocking said discharge actuating means from said released position.

* * * * *